US006742481B2

(12) United States Patent
Baldwin

(10) Patent No.: US 6,742,481 B2
(45) Date of Patent: Jun. 1, 2004

(54) PISTON COOLING OIL SYSTEM WITH WINDAGE TRAY

(75) Inventor: Steven R. Baldwin, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/252,616

(22) Filed: Sep. 23, 2002

(65) Prior Publication Data

US 2004/0055545 A1 Mar. 25, 2004

(51) Int. Cl.[7] ..... F01P 3/08

(52) U.S. Cl. ..... 123/41.35; 123/195.4; 184/6.5

(58) Field of Search ..... 123/41.35, 195 U, 123/196 R, 195 C; 184/6.5

(56) References Cited

U.S. PATENT DOCUMENTS 6,019,071 A * 2/2000 Maciejka, Jr. ..... 123/41.35

* cited by examiner

*Primary Examiner*—Noah P. Kamen

(74) *Attorney, Agent, or Firm*—Leslie C. Hodges

(57) ABSTRACT

In a preferred embodiment, a windage tray assembly is mounted to crankshaft bearing caps which connect with oil passages in the windage tray. The passages carry the oil through nozzles directed toward the interior of associated pistons. The arrangement utilizes the windage tray and bearing caps as carriers for piston cooling oil obtained from the bearing caps, which are already supplied with oil for lubricating the bearings. Thus, modifications of an engine design to install a piston cooling system are limited to redesign of the windage tray to a sandwich-like assembly and modification of the bearing caps to conduct oil from the bearings to the windage tray passages. To limit oil pumping energy, oil distribution holes in the bearing caps connect intermittently with crankshaft journal feed passages so the oil is distributed in individually timed streams or sprays directed toward the pistons for a short interval once every revolution of the engine crankshaft.

6 Claims, 4 Drawing Sheets

PISTON COOLING OIL SYSTEM WITH WINDAGE TRAY

TECHNICAL FIELD

This invention relates to piston engines and more particularly to piston cooling oil systems wherein oil is sprayed into the pistons from a crankcase mounted windage tray having internal oil delivery passages.

BACKGROUND OF THE INVENTION

It is known in the engine art to provide piston cooling oil sprayed against the inside of the individual pistons of an engine to cool the pistons to obtain higher engine power output or increased piston life. Such systems have been commonly used on many models of diesel engines but have generally not been used in automotive gasoline powered engines. However, in high output gasoline engines and for other engines for the purpose of increased emission control, the possibility of further extension of piston cooling in spark ignition engines has been considered.

Conventionally, piston cooling systems have operated with piston cooling nozzles through which oil is continuously applied in a stream or a spray on the piston interiors. The provision of such a system generally requires internal engine modifications and equipment which make difficult its application to engines previously manufactured. In addition, the continuous delivery of oil for cooling requires increased oil pumping capacity which uses energy and thereby reduces engine efficiency. A system in which these problems may be reduced or overcome is accordingly desired.

SUMMARY OF THE INVENTION

The present invention provides a piston cooling system for an engine which may be relatively easily adapted to engines in current production as well as to new engine designs. The system modifies the windage tray, commonly used in engines to reduce oil aeration, to provide an assembly through which piston cooling oil may be delivered to the underside of the engine pistons.

Instead of a single stamped sheet, the windage tray may be made from a pair of sheets, of metal or a suitable non-metallic material, which are welded or bonded together to form an assembly. One or both sheets are embossed so as to provide internal oil passages between the sheets that are used to transport oil from individual inlet openings to outlet openings provided with nozzles for directing cooling oil to each of the pistons individually.

In a preferred embodiment, the windage tray assembly is mounted to lower ends of the crankshaft bearing caps that support the engine crankshaft. The bearing caps include oil passages that carry oil from the pressure lubricated bearings supporting the crankshaft to outlet connections that feed oil to the inlet openings in the windage tray. The internal passages in the tray carry the oil from the inlet openings to outlet openings positioned on the tray so as to direct oil through the nozzles toward the interiors of the respective pistons. The arrangement utilizes the windage tray and bearing caps as carriers for piston cooling oil obtained from the bearing caps which are already supplied with oil for lubricating the bearings. Thus, modifications of the engine required to install a piston cooling system are limited to redesign of the windage tray to a sandwich-like assembly with oil passages and modification of the bearing caps to conduct oil from the bearings to the windage tray passages.

In order to reduce the energy expended in pumping the piston cooling oil, the engine bearing caps and the bearings therein may be modified to connect with oil feed holes in the associated crankshaft bearing journals so that oil distribution holes in the bearing caps connect intermittently with the crankshaft journal feed passages. Thus, oil is distributed in individually timed streams or sprays directed toward the pistons for a short interval once every revolution of the engine crankshaft. In this way, the amount of cooling oil utilized is limited and the energy expended in pumping the cooling oil is reduced, allowing for increased efficiency of the engine.

These and other features and advantages of the invention will be more fully understood from the following description of certain specific embodiments of the invention taken together with the accompanying drawings.

DESCRIPTION OF THE PREFERRED EMBODIMENT

Figure 1:
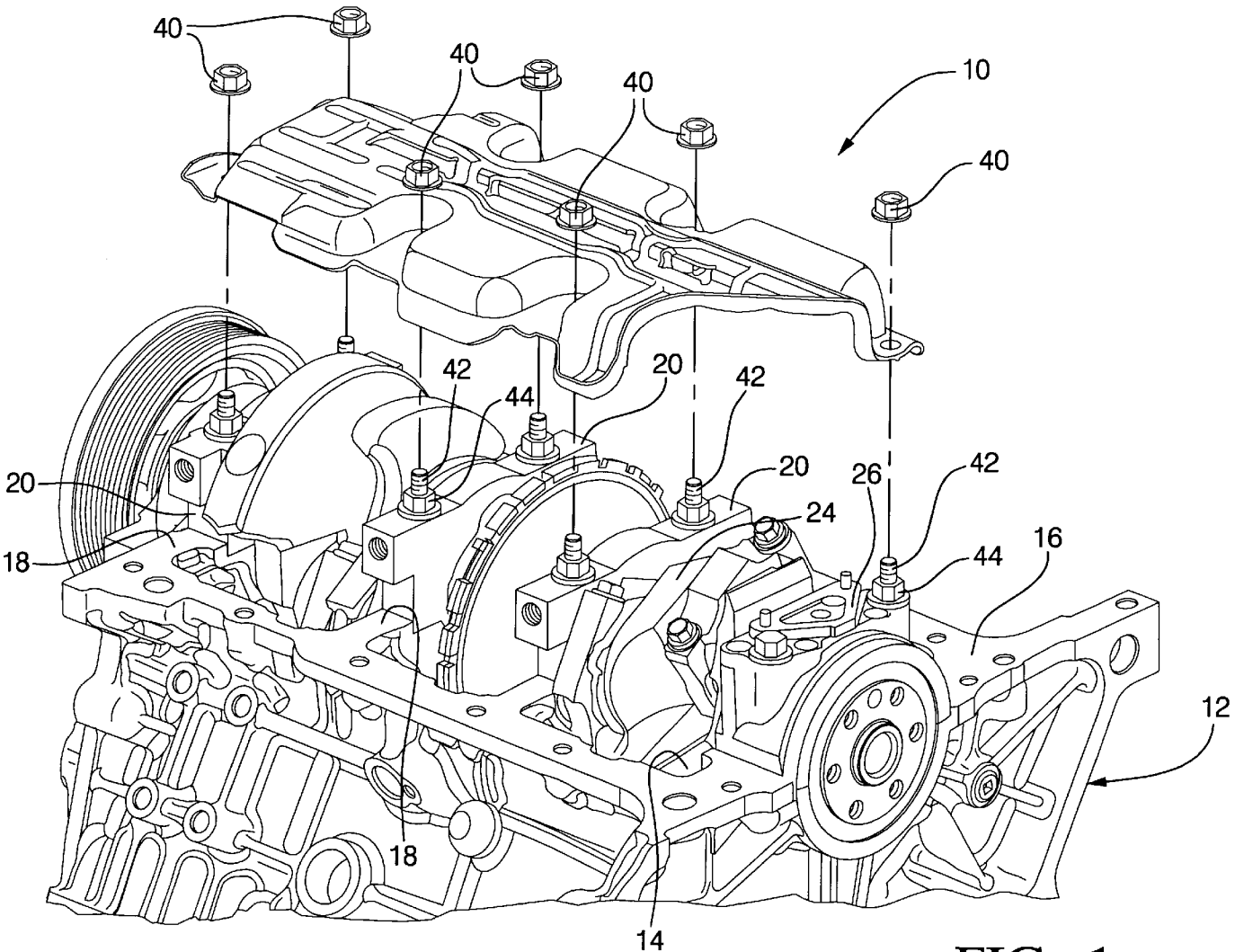
FIG. 1 is a pictorial view partially exploded showing inverted a lower portion of an engine assembly including a modified windage tray and piston cooling oil distribution assembly according to the invention.

Referring now to the drawings in detail, numeral 10 generally indicates an engine having a cylinder block 12 including cylinders with pistons, not shown, and defining the upper portion of a crankcase 14. The cylinder block has a lower mounting surface 16 which is adapted to connect with a lower crankcase member carrying an oil pan, neither of which is shown. The cylinder block includes transverse webs 18 with attached bearing caps 20 which include aligned openings receiving bearings 22 (FIG. 3) supporting the journals 23 (FIG. 2) of an associated crankshaft 24. The engine has an internal oil pump 26 which is conventionally arranged to receive oil from an oil sump in the engine oil pan and pump pressurized oil for lubricating various mechanisms of the engine.

Figure 2:
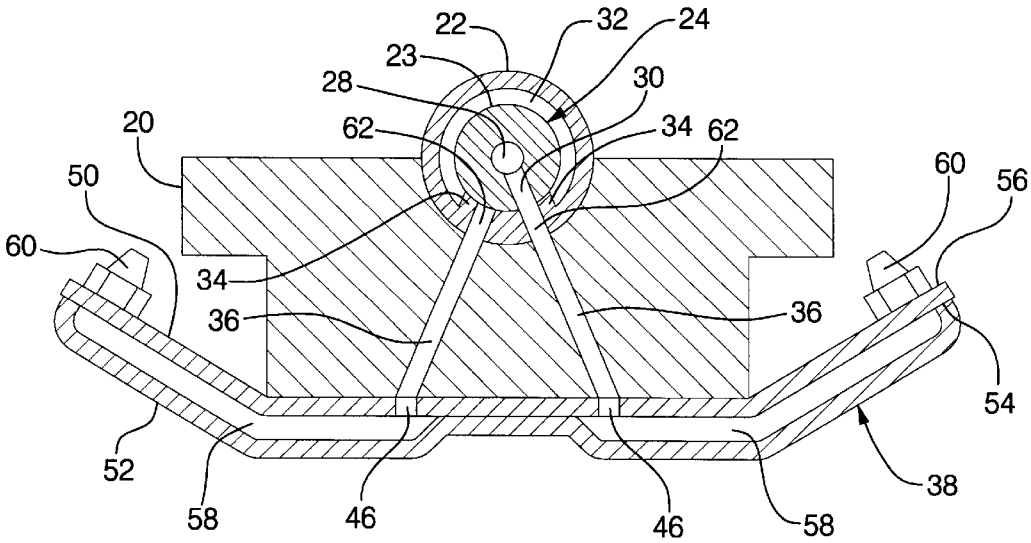
FIG. 2 is a transverse cross-sectional view through the engine and windage tray assembly showing some of the internal oil passages.
Figure 3:
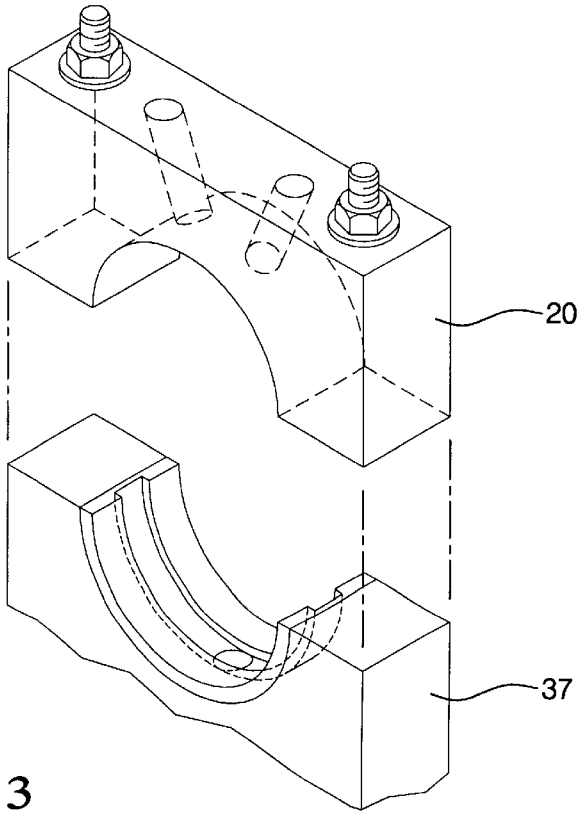
FIG. 3 is an inverted pictorial view of the engine bearing block and cap portions which support the engine crankshaft.
Figure 4:
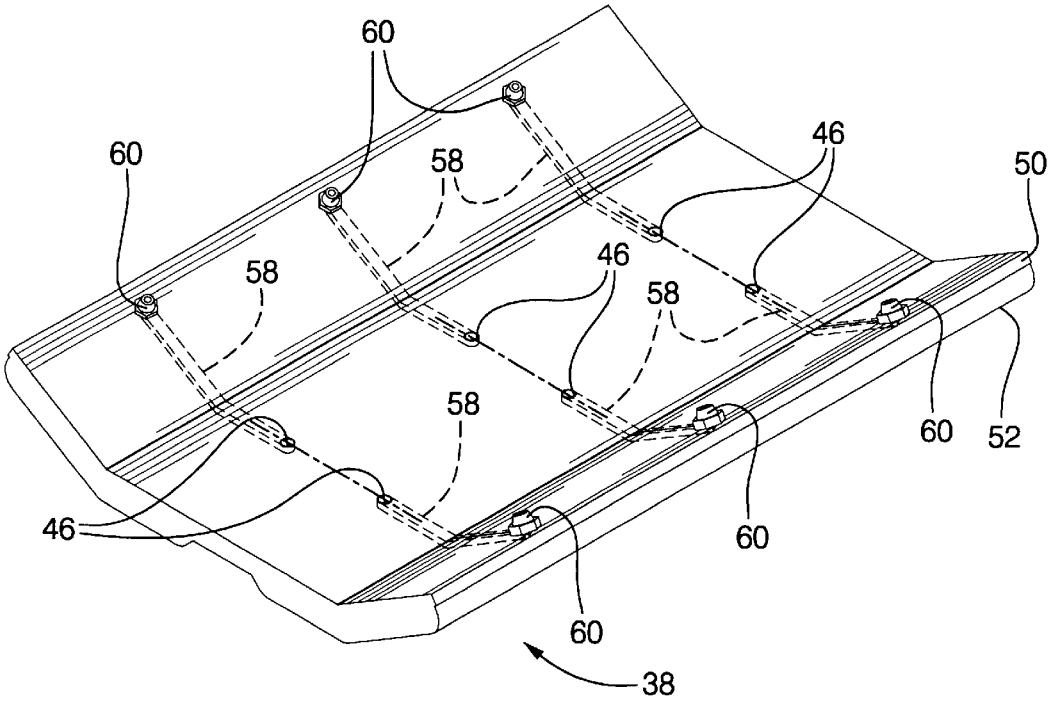
FIG. 4 is a pictorial view of the exemplary tray assembly of FIG. 2.

Some of the oil is pumped into a hollow center 28 (FIG. 2) of the crankshaft, which forms a passage extending into each of the main bearing journals. Radial passages 30 in the journals carry the oil from the hollow centers 28 to the surface of the main journals where it is distributed into grooves 32 for lubricating the surface of the main bearing inserts. At appropriate locations of the bearing cap inserts, the bearing grooves 32 are interrupted by short segments 34 that communicate with connecting passages 36 extending from the bearing segments to the exterior of the associated bearing caps 20. Alternatively, as shown in FIG. 3, oil supplied through the engine crankcase webs 37 may be delivered through cross drilled passages, not shown, in the crankshaft main journals to the main bearing shells and, through openings, to the bearing caps 20.

The engine includes a windage tray and piston cooling oil distribution assembly 38, referred to hereinafter as the assembly or the windage tray. The windage tray is mounted to the bottoms of the bearing caps 20 by nuts 40 which are threaded onto mounting studs 42 to hold the windage tray against the mounting nuts 44 provided for the bearing caps.

The windage tray preferably includes an oil inlet opening 46 for each engine piston. Each of the openings 46 is connected with one of the bearing cap connecting passages 36 by any suitable means, such as a direct mounting, as shown in FIG. 2, or a separate connector, not shown, that extends between each of the connecting passages and its associated inlet opening 46.

The windage tray assembly is formed by upper and lower preformed members 50, 52 which are preferably metal, having opposed faces 54, 56 with engaged portions that are welded together to form the assembly 38. The tray assembly includes a plurality of oil recesses preformed into the upper and/or lower stampings of the windage tray assembly to define sealed oil passages 58 that extend from the inlet openings 46 to respective outlet nozzles 60 mounted at opposite ends of each of the sealed oil passages and positioned to conduct a stream of cooling oil upward toward the interior of an associated piston, not shown.

In operation of the engine, the oil pump 26 provides pressurized oil to the hollow centers 28 of the crankshaft journals 23 from which it is conducted to the bearing surfaces through the radial passages 30. Some of the pressurized oil is distributed through grooves 32 to the bearing surfaces for lubricating the crankshaft journals 23. However, this flow is interrupted briefly once each crankshaft revolution when the radial passages 30 connect with feed holes 62 in the bearings and sequentially send pulses of pressurized oil through the feed holes and connecting passages 36 of the bearing caps 20 into the inlet openings 46 of the windage tray assembly 38. The timed oil pulses are delivered through the sealed oil passages 58 to the outlet nozzles 60 which send a stream of oil directly to the interior of the associated pistons for cooling them. Since each piston is heated by combustion only once every two cycles, the piston cooling oil is intermittently received within each piston twice between each combustion event of the respective piston, assuming the engine is a conventional four-stroke cycle engine.

If desired, the feed holes 62 in the bearings may be circumferentially extended a small amount to provide increased amounts of oil during each communication with the crankshaft passages 30. Also, it would be possible to extend a groove between the bearing feed holes 62 to increase the time in which the crankshaft passages 30 are connected with both of the bearing cap connecting passages 36 so that oil is delivered to the pistons over a greater period of angular rotation of the crankshaft. In a still further alternative, each bearing cap could have a single connecting passage which connects with dual sealed oil passages in the windage tray.

Figure 5:
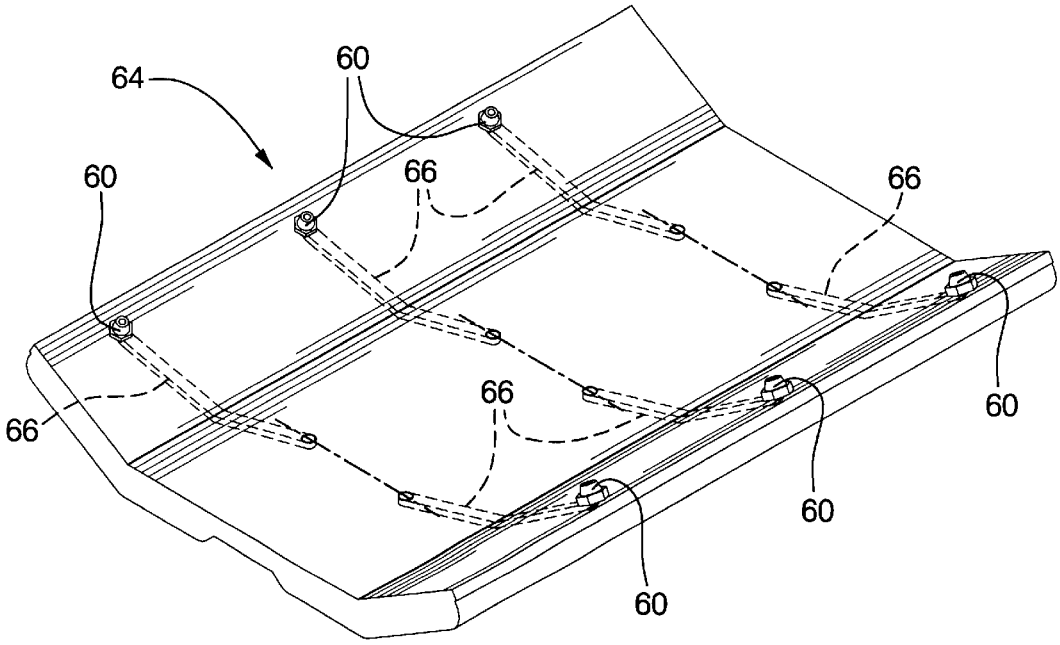
FIG. 5 is a view similar to FIG. 4 showing an alternate passage arrangement.

FIG. 5 illustrates an alternative windage tray assembly 64 wherein the internal oil passages 66 are reconfigured to extend outward and forward or rearward in the tray. This positions the outlet nozzles 60 below the cylinders rather than to one side as in tray 38 previously described.

Figure 6:
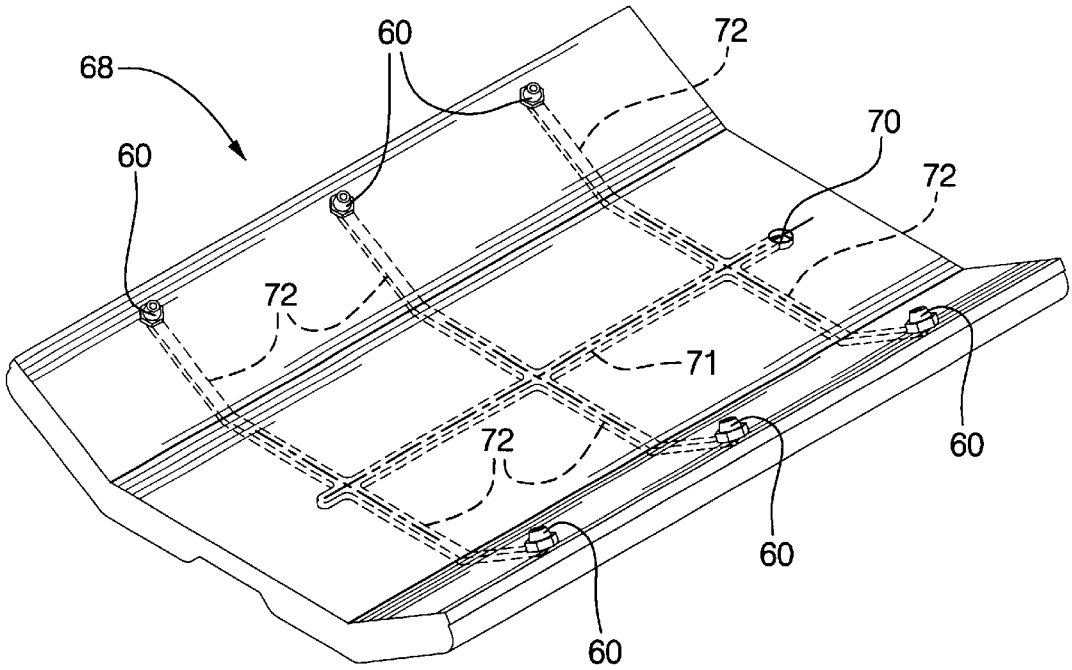
FIG. 6 is still another view similar to FIG. 4 showing an alternate passage arrangement having a single inlet.

FIG. 6 shows still another alternative windage tray assembly 68 wherein a single inlet 70 is provided for admitting pressurized oil into a windage tray passage 71 and oil passages 72 that feed nozzles 60. The single inlet could be connected to the oil pump in any suitable manner and would provide full cooling oil flow to all the pistons continuously. Thus, it could simplify modifications to the engine bearings and bearing caps but would not necessarily have the benefit of lower oil flow provided by embodiments of the invention previously discussed.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A windage tray and piston cooling oil distribution assembly for an engine, said assembly comprising:

upper and lower preformed members having opposed faces with engaged portions defining sealed oil passages between the members;

at least one inlet opening for delivering pressurized oil to the oil passages; and a plurality of outlet openings each including a nozzle for directing a stream of cooling oil against an associated piston of the engine;

wherein the preformed members are sheets, at least one sheet having formed recesses that define the sealed oil passages.

2. An assembly as in claim 1 wherein the preformed members are stamped metal.

3. An engine piston cooling system comprising:

an engine having an oil pump and internal oil passages for conducting pressurized oil to crankshaft bearing supports for lubricating shaft bearings and associated journals of a crankshaft supported therein;

a windage tray and piston cooling oil distribution assembly supported in the engine below the crankshaft, the tray assembly including:

upper and lower preformed members having opposed faces with engaged portions defining sealed oil passages between the members;

at least one inlet opening for delivering pressurized oil to the oil passages; and a plurality of outlet openings each including a nozzle for directing a stream of cooling oil against an associated piston of the engine;

wherein said tray assembly is mounted to the engine crankshaft bearing supports, each bearing support having at least one oil supply passage, said tray assembly including a plurality of inlet openings, at least one connected with each of the bearing support oil supply passages; and the tray assembly includes an inlet opening for each piston of the engine, each of the inlet openings joining with a separate one of the sealed oil passages which connects with a nozzle for directing cooling oil to the associated piston.

4. A system as in claim 3 wherein the internal oil passages include passages in the crankshaft journals that, in operation, rotate to communicate intermittently with the inlet openings of the tray assembly and send timed pressure oil pulses to the outlet nozzles for delivery of intermittent oil streams to the pistons.

5. An engine piston cooling system comprising:

an engine having an oil pump and internal oil passages for conducting pressurized oil to crankshaft bearing supports for lubricating shaft bearings and associated journals of a crankshaft supported therein;

a windage tray and piston cooling oil distribution assembly supported in the engine below the crankshaft, the tray assembly including:

upper and lower preformed members having opposed faces with engaged portions defining sealed oil passages between the members;

at least one inlet opening for delivering pressurized oil to the oil passages; and a plurality of outlet openings each including a nozzle for directing a stream of cooling oil against an associated piston of the engine;

wherein the preformed members of the tray assembly are sheets, at least one sheet having formed recesses that define the sealed oil passages.

6. A system as in claim 5 wherein the preformed members are stamped metal.

* * * * *